US007603983B2

(12) United States Patent
Bähner et al.

(10) Patent No.: US 7,603,983 B2
(45) Date of Patent: Oct. 20, 2009

(54) CARBURETOR AND METHOD OF OPERATING THE SAME

(75) Inventors: Andreas Bähner, Weinstadt (DE); Andreas Lingen, Althütte (DE); Hans Nickel, Weissach (DE); Bärbel Nickel, legal representative, Weissach (DE); Claus Naegele, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 12/216,564

(22) Filed: Jul. 8, 2008

(65) Prior Publication Data

US 2009/0013965 A1 Jan. 15, 2009

(30) Foreign Application Priority Data

Jul. 12, 2007 (DE) ..... 10 2007 032 526

(51) Int. Cl.
*F02M 7/26* (2006.01)

(52) U.S. Cl. ..... 123/438; 123/179.16; 123/179.18; 261/39.1

(58) Field of Classification Search ..... 123/438, 123/491, 179.16, 179.18; 261/39.1–39.4
See application file for complete search history.

(56) References Cited

U.S. PATENT DOCUMENTS

| | | | | |
|---|---|---|---|---|
| 4,672,929 | A * | 6/1987 | Wissmann et al. | 123/179.18 |
| 4,676,204 | A * | 6/1987 | Inoguchi et al. | 123/179.16 |
| 4,770,823 | A * | 9/1988 | Sejimo | 261/39.1 |
| 5,648,023 | A * | 7/1997 | Nojima | 261/44.4 |
| 6,851,664 | B2 * | 2/2005 | Gangler et al. | 261/64.3 |
| 6,932,058 | B2 | 8/2005 | Nickel et al. | |
| 2002/0113326 | A1 * | 8/2002 | Takano et al. | 261/39.2 |

* cited by examiner

*Primary Examiner*—Erick Solis
(74) *Attorney, Agent, or Firm*—Walter Ottesen

(57) ABSTRACT

A carburetor (1, 51) has an intake channel (2) wherein a throttle element and a choke element are arranged with the choke element being upstream of the throttle element. The choke element is displaceable between an operating position (8) and at least one starting position (9). A first fuel path is provided which supplies fuel to the intake channel section (2) in dependence upon the underpressure present therein. A first controllable valve (20) for controlling the supplied fuel quantity is mounted in the first fuel path. In order to achieve an adapted fuel supply in different operating states, a second fuel path is provided which defines a bypass line to the first valve (20). A second valve (44, 54) is mounted in the second fuel path. A method for operating the carburetor (1, 51) provides that the second valve (44, 54) is actuated in dependence upon at least one operating parameter of the carburetor (1, 51).

25 Claims, 2 Drawing Sheets

CARBURETOR AND METHOD OF OPERATING THE SAME

CROSS REFERENCE TO RELATED APPLICATION

This application claims priority of German patent application no. 10 2007 032 526.8, filed Jul. 12, 2007, the entire content of which is incorporated herein by reference.

BACKGROUND OF THE INVENTION

U.S. Pat. No. 6,932,058 discloses a carburetor for an internal combustion engine wherein the carburetor has a switchable valve. The switchable valve is mounted in a fuel path which leads from a storage space and is connected to a main fuel opening. From this fuel path, a further fuel path branches off downstream of the valve and this further fuel path feeds an idle system and a part-load fuel path. The controllable valve thereby controls the total fuel quantity supplied to the intake channel.

It has been shown that an inadequate fuel supply can take place in some operating states, especially, in transitional states.

SUMMARY OF THE INVENTION

It is an object of the invention to provide a carburetor and a method of operating the same with which an improved fuel feed is achieved.

The carburetor of the invention includes: an intake channel; a throttle element movably mounted in the intake channel; a choke element movably mounted in the intake channel upstream of the throttle element; the choke element being displaceable between an operating position wherein the choke element is open and at least one start position wherein the choke element reduces the cross section of the intake channel relative to the cross section thereof in the operating position; a first fuel path for supplying fuel to the intake channel in dependence upon the underpressure present in the intake channel; a first valve mounted in the first fuel path for controlling the quantity of the supplied fuel; a second fuel path defining a bypass line to the first controllable valve; and, a second valve mounted in the second fuel path.

It has been shown that, when controlling the total fuel quantity supplied to the intake channel via the switchable valve in pregiven operating states, especially, at idle, the supply of fuel can be inadequate. In order to correct this deficiency, a second fuel path is provided which defines a bypass line to the first valve. A minimum supply of fuel can be ensured via the bypass line, for example, at idle. In this way, the first valve can be controlled in a manner known per se in dependence upon the rotational speed of the internal combustion engine or of another operating parameter of the engine. An adequate fuel supply is ensured because of the bypass line also at a low idle rpm.

It has, however, been shown that in other operating states, especially during starting of the engine, too large a fuel quantity can be supplied via the bypass line. This is especially the case when during starting, a choke element in the intake channel is shifted into a start position. The underpressure in the intake channel increases because of the start position of the choke element and this underpressure leads to an increase of the fuel quantity drawn in via the bypass line and thereby leads to an overenrichment of the mixture which can lead to a stalling of the engine.

In order to avoid this, a second valve is mounted in the second fuel path. In this way, the fuel feed via the second fuel path can be reduced or switched off in pregiven operating states. In this way, a fuel feed via the carburetor can be achieved which is adapted to each operating state.

Advantageously, the position of the second valve is coupled to at least one operating parameter of the carburetor. The position of the second valve is especially coupled to the position of the choke element. However, the position of the second valve can be coupled to another operating parameter of the carburetor, for example, to the underpressure in the intake channel, which is formed in the carburetor, or is coupled to the position of the throttle element or the like.

A mechanical coupling is advantageously provided. However, a pneumatic coupling can also be provided. A control unit for actuating at least one valve is provided. The control unit is connected especially to at least one means for detecting at least one operating parameter of the carburetor. In this way, the control unit can control the second valve in dependence upon the operating parameter of the carburetor. The coupling of the position of the second valve to the position of the choke element can thereby take place electrically via the control unit. Advantageously, the position of the choke element is an operating parameter of the carburetor and a means is provided for detecting the position of the choke element. Advantageously, the control unit is connected to at least one means for detecting an operating parameter of the engine. It is especially provided that the first valve is controlled in dependence upon the operating parameter of the internal combustion engine. The two valves are thereby controlled via different operating parameters, namely, the first valve is controlled via an operating parameter of the internal combustion engine and the second valve is controlled by an operating parameter of the carburetor. In this way, a well adapted fuel supply can be achieved in a simple manner.

The first fuel path is the main fuel path and opens into the intake channel in the region of a venturi. The second fuel path is especially a part-load fuel path. Advantageously, the second fuel path opens downstream of a venturi, which is formed in the intake channel, and in a region of the intake channel which lies upstream of the throttle element in the completely opened position of the throttle element. In the completely closed position of the throttle element, the opening of the second fuel path thereby lies between the venturi and the throttle element. Advantageously, a fixed throttle is mounted in the second fuel path. With a suitable choice of a fixed throttle, the fuel quantity, which is supplied via the second fuel path, can be adjusted.

It is provided that the carburetor is a membrane carburetor with a control chamber delimited by the control membrane. The first fuel path connects especially the control chamber to the intake channel. Advantageously, the second fuel path connects the control chamber to the intake channel. The second fuel path thereby defines a separate connection between control chamber and intake channel. It can, however, also be provided that the second fuel path connects the control chamber to the first fuel path and opens into the first fuel path downstream of the first valve. In this way, the second fuel path is configured as a bypass line which bypasses only the first valve and, if required, additional throttles or the like mounted in this segment of the first fuel path. Advantageously, the carburetor has at least one idle fuel opening which opens into the intake channel in the region of the throttle element and is supplied from an idle fuel path. Advantageously, the idle fuel path branches out from the first fuel path. The idle system is thereby configured as a dependent system. Also, the fuel quantity, which is supplied to the idle fuel path, is controlled via the first valve.

Advantageously, the choke element is a choke flap and the throttle element is a throttle flap. The choke element opens completely in the operating position and is substantially closed in the start position.

The method of the invention is for operating a carburetor for an internal combustion engine wherein the carburetor includes: an intake channel; a throttle element pivotally mounted in the intake channel; a choke element pivotally mounted in the intake channel upstream of the throttle element; the choke element being displaceable between an operating position wherein the choke element is open and at least one start position wherein the choke element reduces the cross section of the intake channel relative to the cross section thereof in the operating position; a first fuel path for supplying fuel to the intake channel in dependence upon the underpressure present in the intake channel; and, a first valve mounted in the first fuel path for controlling the quantity of the supplied fuel. The method includes the steps of: displacing the choke element into the one start position for starting the engine; providing a second fuel path defining a bypass line to the first valve; arranging a second valve in the second fuel path; and, actuating the second valve in dependence upon at least one operating parameter of the carburetor.

The second valve, which is arranged in the second fuel path, is actuated in dependence upon at least one operating parameter of the carburetor. For this reason, the fuel quantity, which is supplied to the intake channel, can also be adapted to the operating parameter of the carburetor. In this way, the supplied fuel quantity can be well adapted.

Advantageously, the operating parameter is the position of the choke element. However, other operating parameters can also be applied additionally or alternatively for actuating the second valve, for example: the underpressure present in the intake channel; the position of a throttle element; or the like. The second valve is partially closed especially for a shift of the choke element into a start position. With the position of the choke element in the start position, the underpressure, which is present in the intake channel, increases because the choke element reduces the flow cross section in the intake channel. In this way, the fuel quantity supplied via the bypass line increases. This can be compensated by at least partially closing the second valve when displacing the choke element into a start position. The valve is only partially closed so that a reduced fuel quantity is drawn into the intake channel via the bypass line. However, the second valve can be completely closed so that no fuel is drawn in via the bypass line.

Advantageously, the first valve is controlled in dependence upon at least one operating parameter of the internal combustion engine. The operating parameter is then especially an rpm of the internal combustion engine.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
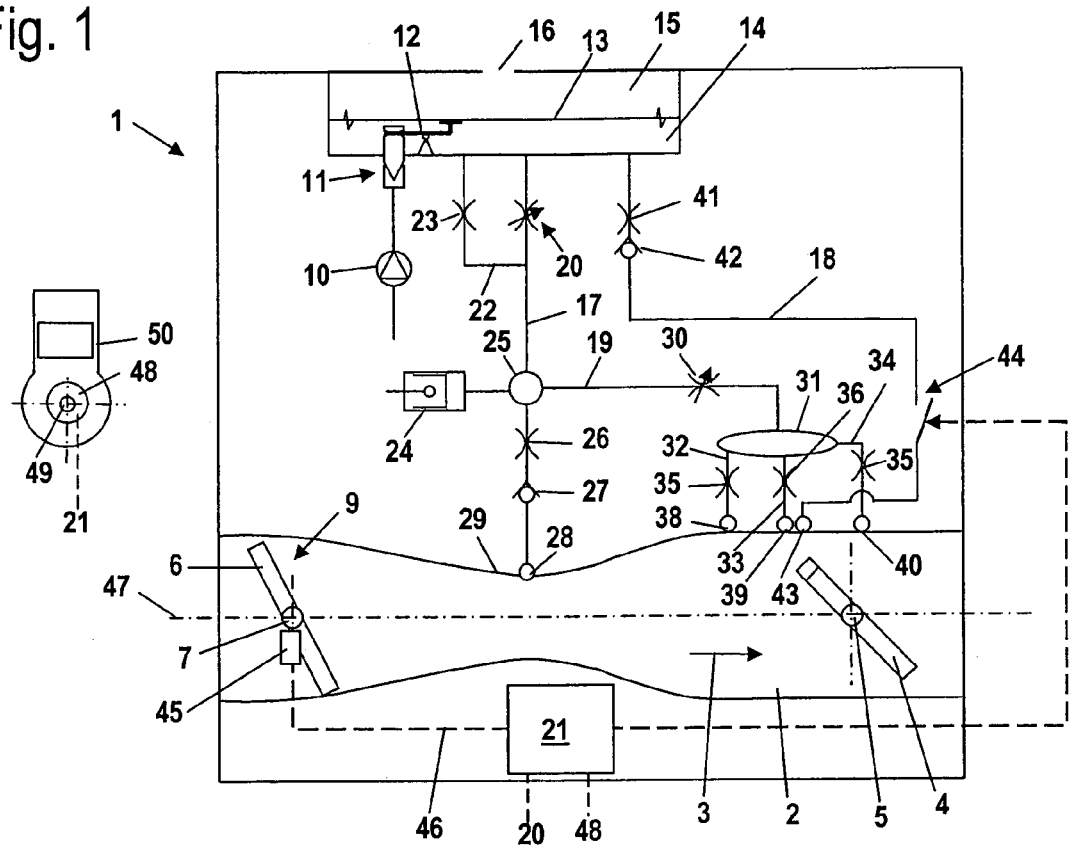
FIG. 1 is a schematic showing an embodiment of a carburetor with the choke flap in the start position.

The carburetor 1 shown schematically in FIG. 1 serves to supply an air/fuel mixture to an internal combustion engine 50. The internal combustion engine 50 can, for example, be a two-stroke engine, a mixture-lubricated four-stroke engine or a separately-lubricated four-stroke engine and serves especially to drive a work tool in a portable handheld work apparatus such as a motor-driven chain saw, cutoff machine, brushcutter or the like. The internal combustion engine 50 is configured as a single-cylinder engine. The internal combustion engine 50 has a rotatably driven crankshaft 49 which drives the work tool of the work apparatus. A generator 48 is mounted on the crankshaft 49 and supplies energy for operating a control unit 21 and/or for a spark plug (not shown). In lieu of the generator 48, a magnet can also be provided for inducing ignition voltage into an ignition coil of the internal combustion engine 50. The generator 48 supplies an rpm signal. The rpm signal is evaluated by the control unit 21.

An intake channel 2 is formed in the carburetor 1 and combustion air is drawn by suction therethrough in flow direction 3 to the internal combustion engine 50. A throttle flap 4 having a throttle shaft 5 is pivotally journalled in the intake channel 2. A choke flap 6 having a choke shaft 7 is pivotally journalled upstream of the throttle flap 4. In FIG. 1, the choke flap 6 is disposed in a start position wherein the choke flap 6 at least partially closes the flow cross section in the intake channel 2. Especially, the choke flap 6 substantially closes the flow cross section in the intake channel 2 in the start position 9. The choke flap 6 can have several start positions 9 wherein the choke flap 6 reduces the flow cross section in the intake channel 2 by different amounts.

A venturi 29 is formed in the flow direction 3 between the choke flap 6 and the throttle flap 4. A main fuel opening 28 opens into the intake channel 2 at the venturi 29. The narrowest location of the venturi 29 lies between the rotational axis of the choke shaft 7 and the rotational axis of the throttle shaft 5.

Idle fuel openings open one behind the other in flow direction 3 in the region of the throttle flap 4 into the intake channel 2, namely: a first idle fuel opening 38, a second idle 1S fuel opening 39 and a third idle fuel opening 40 as well as a part-load fuel opening 43. The third idle fuel opening 40 lies downstream of the throttle flap 4 in each position thereof. In the completely closed position of the throttle flap 4, the idle fuel openings 38 and 39 as well as the part-load fuel opening 43 lie ahead of the throttle flap 4. The part-load fuel opening 43 is arranged in flow direction 3 between the second idle fuel opening 39 and the third idle fuel opening 40.

The carburetor 1 has a fuel pump 10 for supplying fuel. The fuel pump 10 is, for example, configured as a membrane pump and can be driven by fluctuating pressure in the crankcase of the internal combustion engine 50. The fuel pump 10 moves the fuel into a control chamber 14 which is delimited at one side by the control membrane 13. A compensating chamber 15 is arranged on the side of the control membrane 13 facing away from the control chamber 14. The compensating chamber 15 communicates with a compensation space via a compensation opening 16 with a reference pressure being present in the compensation space. The compensation space can, for example, be the ambient or the clean end of an air filter with which the intake channel 2 is connected.

An inlet valve 11 is mounted at the inlet into the control chamber 14. The position of the inlet valve 11 is coupled via a lever 12 to the position of the control membrane 13. When an underpressure is present in the control chamber 14, then the inlet valve 11 opens and the fuel pump 10 moves fuel into the control chamber 14. The inlet valve 11 remains closed when there is an overpressure in the control chamber 14.

The control chamber 14 is connected via a main fuel path 17 to the main fuel opening 28 and opens into the intake channel 2 via the main fuel opening 28. A first controllable valve 20 is mounted in the main fuel path 17 and this valve is controlled by the control unit 21. The controllable valve 20 can be adjusted especially between the open position and the closed position. In order to control the fuel quantity, the first valve 20 can be pulse driven or can be opened and closed in short time intervals.

An annular gap 25 is provided in the main fuel path 17 downstream of the first valve 20. The annular gap 25 can be provided at a carburetor set screw with which the level of the supplied fuel quantity can be adjusted by the operator. The annular gap 25 is connected via a main throttle 26 and a check valve 27 to the main fuel opening 28. The main throttle 26, the check valve 27 and the main fuel opening 28 can be configured at a main discharge nozzle in a manner known per se. A fuel path opens at the annular gap 25 and this fuel path is connected to an accelerator pump 24. In this way, additional fuel can be supplied into the intake channel 2 during acceleration.

At the annular gap 25, an idle fuel path 19 branches off from the main fuel path 17. The idle fuel path 19 is connected via an adjustable idle throttle 30 to an idle emulsion chamber 31. The idle emulsion chamber 31 feeds the idle fuel openings 38, 39 and 40. For this purpose, the idle emulsion chamber 31 is connected via a first path 32 to the first idle fuel opening 38. A first fixed throttle 35 is mounted in the first path 32. The idle emulsion chamber 31 is connected to the second idle fuel opening 39 and a second fixed throttle 36 is mounted in the second path 33. The idle emulsion chamber 31 is connected to the third idle fuel opening 40 via a third path 34 in which a third fixed throttle 37 is mounted. The idle fuel path 19 branches off from the main fuel path 17 downstream of the first valve 20. For this reason, the fuel quantity, which is supplied to the idle fuel path 19, is controlled via the first valve 20.

The carburetor 1 has a bypass path 22 which connects the control chamber 14 to the first fuel path 17 downstream of the first valve 20. A fixed throttle 23 is mounted in the bypass path 22.

The carburetor 1 has a part-load fuel path 18 which connects the control chamber 14 to the intake channel 2. The part-load fuel path 18 opens via the part-load fuel opening 43 into the intake channel 2. The part-load fuel path 18 likewise defines a bypass line to the first valve 20. A fixed throttle 41 and a check valve 42 are mounted in the bypass line 18. A second valve 44 is also mounted in the part-load fuel path 18 and this valve is coupled via a coupling 46 to the position of the choke flap 6. For this purpose, a sensor 45 is arranged on the choke shaft 7 and detects the position of the choke flap 6 via the position of the choke shaft 7. The sensor 45 is connected via the coupling 46 to the control unit 21. The control unit 21 is connected via the coupling 46 to the second valve 44.

For the start position 9 of the choke flap 6 shown in FIG. 1, the second valve 44 is closed and therefore is in a position wherein no fuel can flow through the second valve 44. The first valve 20 can also be closed. In this way, fuel can be drawn into the intake channel 2 only via the bypass path 22. Because of the fixed throttle 23 mounted in the bypass path 22, the fuel quantity is low also with a large underpressure present in the intake channel 2 so that an overenrichment of the air/fuel mixture is avoided.

The control unit 21 so controls the second valve 44 that the second valve 44 is closed when the choke flap 6 is displaced into its start position 9. If the choke flap 6 has several start positions 9, then the second valve 44 is closed for one or for several of these start positions 9. The second valve 44 can be completely or only partially closed.

Figure 2:
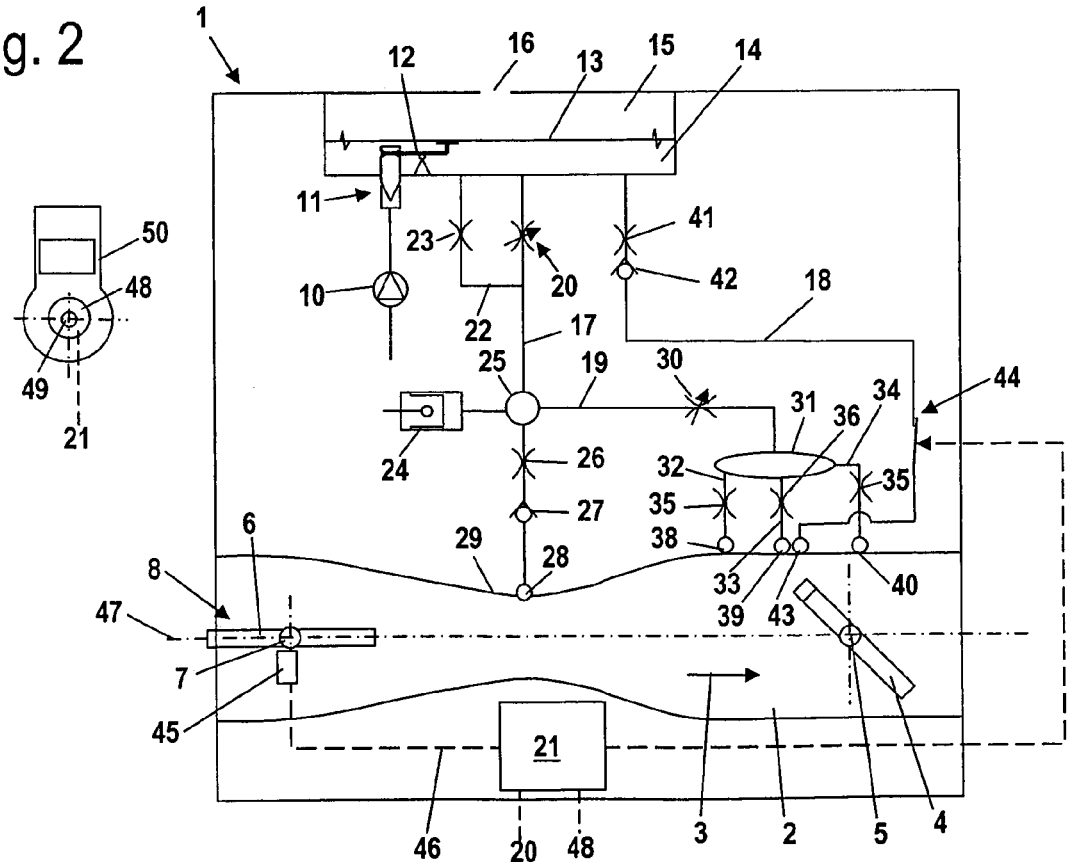
FIG. 2 is a schematic of the carburetor of FIG. 1 with the choke flap in the operating position.

In FIG. 2, the choke flap 6 is shown in its operating position 8. In the embodiment, the choke flap 6 is completely opened in its operating position 8. The choke flap 6 is then approximately parallel to an intake channel longitudinal axis 47. It can, however, be provided that the choke flap 6 is only partially open in the operating position 8. In the operating position 8, the second valve 44 is opened so that fuel can be inducted into the intake channel 2 also via the part-load fuel path 18. The second valve 44 is then especially opened when the choke flap 6 is displaced out of its start position 9 into the operating position 8. In this way, it is ensured that in each position of the choke flap 6, an adapted fuel quantity is inducted.

In this way, the manipulation for the operator is simplified because an overenrichment of the mixture for a closed choke flap 6 is avoided. Also, no overenrichment of the mixture results with a delayed opening of the choke flap 6.

During operation, the first valve 20 is controlled by the control unit 21 especially in dependence upon at least one operating parameter of the internal combustion engine 50. For this purpose, the first valve 20 is likewise connected to the control unit 21. Especially the rpm of the internal combustion engine 50 is provided as an operating parameter. For this purpose, the control unit 21 is connected to the generator 48 which supplies an rpm signal. This is shown schematically in FIGS. 1 and 2.

Figure 3:
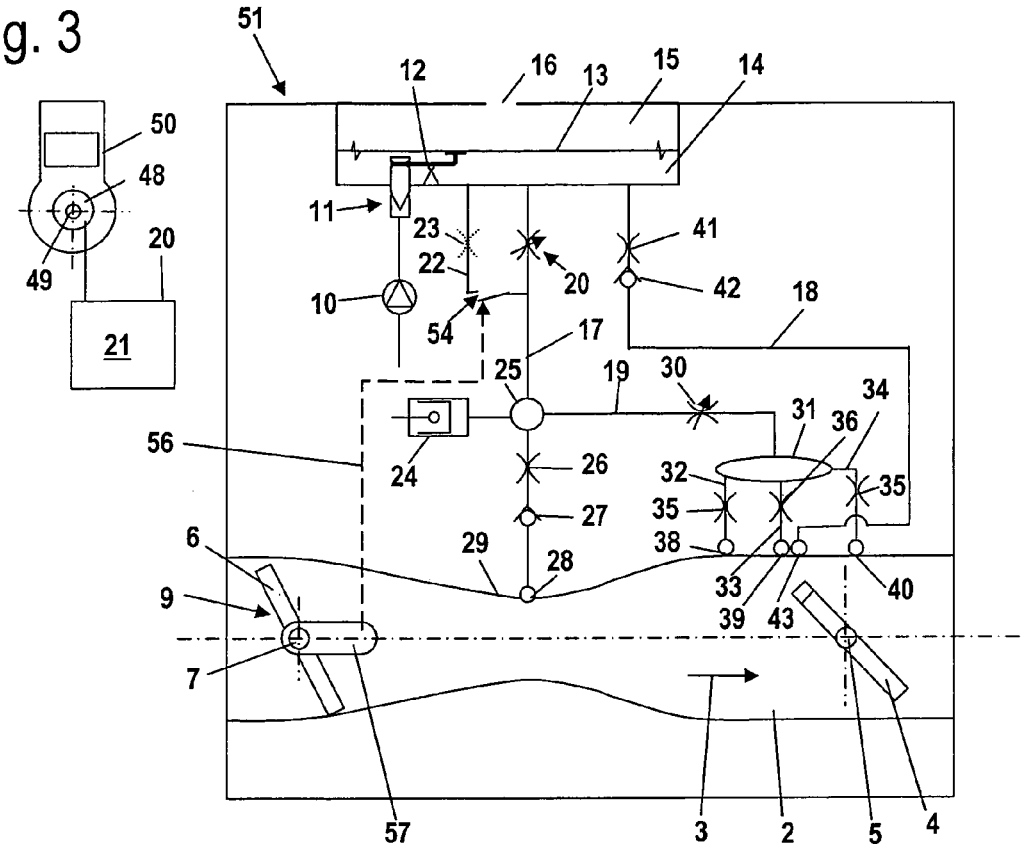
FIG. 3 is a schematic showing another embodiment of the carburetor of the invention; and, FIG. 4 is a schematic showing still another embodiment of the carburetor according to the invention.

FIG. 3 shows an embodiment of a carburetor 51. For the same components as shown in FIGS. 1 and 2, the same reference numerals are used in FIG. 3.

The carburetor 51 likewise has a main fuel path 17, a part-load fuel path 18 and an idle fuel path 19. However, no switchable valve is mounted in the part-load fuel path 18; instead, only the fixed throttle 41 is mounted in the part-load fuel path 18. A switchable second valve 54 is mounted in the bypass path 22 which connects the control chamber 14 to the main fuel path 17 downstream of the first valve 20. In addition, the fixed throttle 23 shown in phantom outline can be mounted in the bypass path 22. The fixed throttle 23 can, however, be omitted. The second valve 54 is connected via a coupling 56 to the choke flap 6. The coupling 56 is mechanically configured. For this purpose, a lever 57 is mounted on the choke shaft 7 so as to rotate therewith. The lever 57 is coupled via the coupling 56 to the position of the second valve 54. In the start position 9 of the choke flap 6 shown in FIG. 3, the second valve 54 is closed so that no fuel flows through the bypass path 22. When rotating the choke flap 7 into the operating position 8, the second valve 54 is opened via the lever 57 and the coupling 56 so that fuel can be inducted via the bypass path 22 and the main fuel path 17 into the intake channel.

It can also be provided that the second valve (44, 54) is controlled in dependence upon other operating parameters of the carburetor 1. For this purpose, the second valve (44, 54) can be controlled, for example, in dependence upon the pressure present in the intake channel 2. For this purpose, a pressure sensor can be mounted in the intake channel 2 which sensor is connected to the control unit 21.

Figure 4:
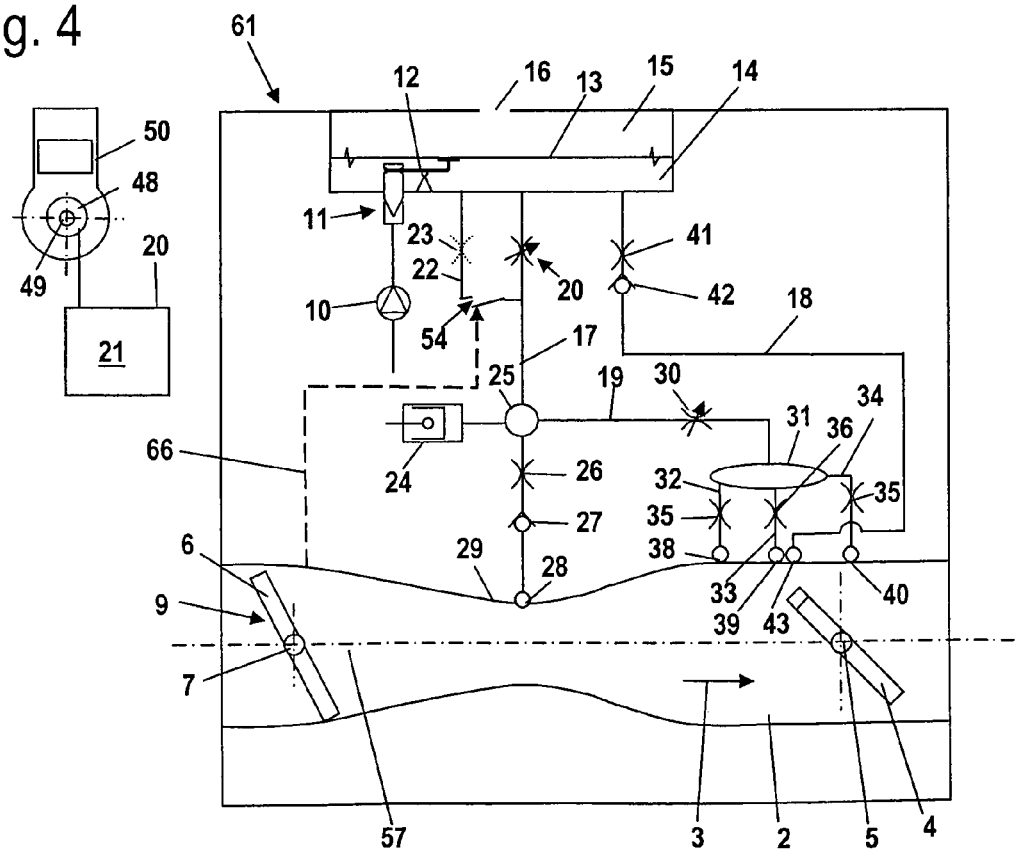

In FIG. 4, a second embodiment of a carburetor 61 is shown whose configuration corresponds essentially to the carburetor 51 shown in FIG. 3. The same components are identified by the same reference numerals.

In the carburetor 61 shown in FIG. 4, a pneumatic coupling 66 of the second valve 54 to the position of the choke flap 6 is provided. The coupling takes place indirectly based on the pressure which adjusts in the intake channel 2 downstream of the choke flap 6 in dependence upon the position of the choke flap. The coupling 66 can, for example, be configured as a hose line which moves the valve 54 via a piston. The coupling 66 is so configured that the valve 54 is closed in the start position 9 of the choke flap and is opened with the pivoting of the choke flap 6 into the operating position 8.

Other possibilities of the coupling can be provided.

It is understood that the foregoing description is that of the preferred embodiments of the invention and that various changes and modifications may be made thereto without departing from the spirit and scope of the invention as defined in the appended claims.

What is claimed is:

1. A carburetor comprising:

an intake channel;

a throttle element movably mounted in said intake channel;

a choke element movably mounted in said intake channel upstream of said throttle element;

said choke element being displaceable between an operating position wherein said choke element is open and at least one start position wherein said choke element reduces the cross section of said intake channel relative to the cross section thereof in said operating position;

a first fuel path for supplying fuel to said intake channel in dependence upon the underpressure present in said intake channel;

a first valve mounted in said first fuel path for controlling the quantity of the supplied fuel;

a second fuel path defining a bypass line to said first controllable valve; and, a second valve mounted in said second fuel path.

2. The carburetor of claim 1, wherein the position of said second valve is coupled to at least one operating parameter of said carburetor.

3. The carburetor of claim 2, wherein said position of said second valve is coupled to the position of said choke element.

4. The carburetor of claim 2, wherein a mechanical coupling is provided.

5. The carburetor of claim 2, wherein a pneumatic coupling is provided.

6. The carburetor of claim 2, further comprising a control unit for actuating at least one of said valves.

7. The carburetor of claim 6, further comprising means for detecting said at least one operating parameter of said carburetor; and, said control unit being connected to said detecting means.

8. The carburetor of claim 7, wherein said operating parameter is the position of said choke element; and, wherein said carburetor further comprises means for detecting said position of said choke flap.

9. The carburetor of claim 6, wherein said carburetor is operatively connected to an internal combustion engine; and, said carburetor further comprising means for detecting said at least one of said operating parameters of said carburetor; and, said control unit being connected to said detecting means.

10. The carburetor of claim 1, wherein said intake channel includes a venturi; and, said first fuel path is the main fuel path and opens into said intake channel at said venturi.

11. The carburetor of claim 1, wherein said second fuel path is a part-load fuel path.

12. The carburetor of claim 1, wherein said intake channel includes a venturi formed therein; said second fuel path opens downstream of said venturi at a region of said intake channel which lies upstream of said throttle flap when said throttle flap is in the fully closed position thereof.

13. The carburetor of claim 1, further comprising a fixed throttle mounted in said second fuel path.

14. The carburetor of claim 1, wherein said carburetor is a membrane carburetor having a control chamber delimited by a control membrane.

15. The carburetor of claim 14, wherein said first fuel path connects said control chamber to said intake channel.

16. The carburetor of claim 14, wherein said second fuel path connects said control chamber to said intake channel.

17. The carburetor of claim 14, wherein said second fuel path connects said control chamber to said first fuel path and opens into said first fuel path downstream of said first valve.

18. The carburetor of claim 1, further comprising at least one idle fuel opening into said intake channel in the region of said throttle element; and, an idle fuel path for feeding said at least one idle fuel opening.

19. The carburetor of claim 18, wherein said idle fuel path branches off said first idle fuel path.

20. The carburetor of claim 1, wherein said choke element is a choke flap and said throttle element is a throttle flap.

21. The carburetor of claim 1, wherein said choke element is fully opened in the operating state and is substantially closed in the start position.

22. A method for operating a carburetor for an internal combustion engine; the carburetor including: an intake channel; a throttle element pivotally mounted in said intake channel; a choke element pivotally mounted in said intake channel upstream of said throttle element; said choke element being displaceable between an operating position wherein said choke element is open and at least one start position wherein said choke element reduces the cross section of said intake channel relative to the cross section thereof in said operating position; a first fuel path for supplying fuel to said intake channel in dependence upon the underpressure present in said intake channel; and, a first valve mounted in said first fuel path for controlling the quantity of the supplied fuel; the method comprising the steps of:

displacing said choke element into said one start position for starting said engine;

providing a second fuel path defining a bypass line to said first valve;

arranging a second valve in said second fuel path; and, actuating said second valve in dependence upon at least one operating parameter of said carburetor.

23. The method of claim 22, wherein said operating parameter is the position of-said choke element.

24. The method of claim 23, comprising the further step of at least partially closing said second valve when displacing said choke element into said start position.

25. The method of claim 22, comprising the further step of controlling said first valve in dependence upon at least one operating parameter of said internal combustion engine.

* * * * *

UNITED STATES PATENT AND TRADEMARK OFFICE

CERTIFICATE OF CORRECTION

PATENT NO. : 7,603,983 B2
APPLICATION NO. : 12/216564
DATED : October 20, 2009
INVENTOR(S) : Andreas Baehner et al.

It is certified that error appears in the above-identified patent and that said Letters Patent is hereby corrected as shown below:

In column 4:
Line 42: delete "1S".

In column 8:
Line 21: add -- opening -- after "opening".
Line 54: delete "of-said" and substitute -- of said -- therefor.

Signed and Sealed this

Twelfth Day of January, 2010

David J. Kappos

David J. Kappos
*Director of the United States Patent and Trademark Office*